United States Patent [19]

Atkinson et al.

[11] Patent Number: 4,736,548

[45] Date of Patent: Apr. 12, 1988

[54] VITRIFIED COMPOSITE WASHITA STONE AND PROCESS FOR PRODUCING SAME

[75] Inventors: Charles W. Atkinson, Howell, Mich.; Carl T. Moody, Little Rock, Ark.

[73] Assignee: Arkansas Hones, Inc., Malvern, Ark.

[21] Appl. No.: 46,036

[22] Filed: Apr. 30, 1987

Related U.S. Application Data

[63] Continuation-in-part of Ser. No. 828,757, Feb. 11, 1986, Pat. No. 4,662,897.

[51] Int. Cl.[4] ..... B24D 3/00

[52] U.S. Cl. ..... 51/293; 51/308; 51/309; 106/85

[58] Field of Search ..... 51/293, 298, 307, 308; 106/85

[56] References Cited

U.S. PATENT DOCUMENTS

| | | | |
|---|---|---|---|
| 1,983,082 | 12/1934 | Howe et al. | 51/293 |
| 2,880,081 | 3/1959 | Eubank | 51/308 |
| 3,003,860 | 10/1961 | Sermon et al. | 51/308 |
| 3,092,476 | 6/1963 | Vatabe | 51/293 |
| 3,142,138 | 7/1964 | Kean et al. | 51/293 |
| 4,541,843 | 9/1985 | Elbel et al. | 51/293 |

*Primary Examiner*—Paul Lieberman
*Assistant Examiner*—Willie J. Thompson
*Attorney, Agent, or Firm*—Stephen D. Carver

[57] ABSTRACT

A process for artificially producing a relatively high density, tinted novaculite Washita stone of relatively homogenous characteristics, and the artificial stone product thereby produced. Tinted and untinted layers of abrasive mix are combined in a lateral pressing step to provide a composite colored stone suitable for subsequent vitrification. The untinted mixture preferably is preferably made from 100 mesh novaculite powder, but alternatively a blend of approximately 100 mesh and 200 mesh novaculite powder is employed. The is mixed with a wetting agent and water, a temporary binder, a flux, and a high refractory frit, yielding the following approximate constituency by weight: approximately 64% of said 100 and 200 mesh novaculite; 5-6% of a temporary binder, approximately 3% of the wetting agent, approximately 2% flux, and approximately 23-25% frit. After screening, the first mixture is completed by blending with ball clay. The tinted mixture is formulated from a supply of the untinted mix and a color glaze which is blended in. Layers of tinted mix are alternated with layers of untinted mix, and the final mixture may be edgewise pressed in the shape of the desired end product at pressures not exceeding three to five tons per square inch. Vitrification is thereafter achieved by firing the pressed parts in an electric furnace up gentle ramps to slowly approach cone 04, and a soak time of approximately 2 hours is preferred.

20 Claims, 1 Drawing Sheet

VITRIFIED COMPOSITE WASHITA STONE AND PROCESS FOR PRODUCING SAME

CROSS-REFERENCE TO RELATED APPLICATION

This application is a continuation-in-part of a presently copending application entitled Vitrified Composite Novaculite and Process for Producing Same, identified by Ser. No. 828,757, filed on Feb. 11, 1986 and now Pat. No. 4,662,897 by the same applicants.

BACKGROUND OF THE INVENTION

The present invention relates generally to a process for artificially producing a high quality, high density abrasive "novaculite" sharpening stone which closely resembles naturally occurring Washita stone. More particularly, the present invention relates to improved processes for producing an artificial, tinted novaculite Washita stone. The invention is believed best classified in U.S. Class 51, Subclass 293.

As explained in detail in our above referenced patent application, novaculite is a form of quartz which itself is primarily comprised of silicon dioxide. In its natural form novaculite has been mined, particularly in Arkanas, for use as a sharpening stone, and it has been known in the trade by the misnomer "Washita." It is increasingly becoming rare. Naturally occurring novaculite typically exhibits density of approximately 2.60 in molecular form, 2.3 in stone form and a MOH hardness of between 7–7.5. with natural stone of 7.5 MOH hardness being very rare.

At the present rate of consumption in domestic cutting shops it is likely that presently known deposits of high grade novaculite will be consumed in the next thirty years. One reason for this is that conventional cutting processes inevitably waste approximately 75% of all quarried stone, in order to arrive at an end product stone which minimizes flaws and which is suitable for honing.

A typical sharpening stone cut from naturally occurring novaculite suffers from several imperfections. First, naturally occurring novaculite is not homogenous and regions of different density exist in the stone. Fissures such as quartz intrusions, cleavage or the like exist along certain fault lines which weaken the stone, and which indicate a region of differential density or sharpening characteristics. Natural stone may experience such deleterious fissures through natural processes when subject to freezing during the winter, and as a result most quarries must mine suitable novaculite at a substantial distance beneath the ground. This further aggravates the present shortage of high grade Novaculite.

Other imperfections which are often associated with mined novaculite Washita stone include sand pits, fault lines, incursions, and quartz seams. Incursions are minor imperfections in the surface such as sand pits which are formed when the stone is cut through and portions of sand naturally formed within the item being cut are exposed. Such sand pits continue to widen and enlarge as time goes on so that such a conventional finished stone product, when used as a sharpener, degrades. Natural novaculite also exhibits substantial color and density difference from sample to sample, which may deleteriously effect the aesthetic value of a finished stone. As explained in our above identified copending application, naturally occurring novaculite subject to the aforementioned difficulties may further interfere with proper knife sharpening.

Notwithstanding the foregoing, natural Washita stone has several attributes when compared to some forms of Novaculite, Washita stone is coarser than Arkansas hard white stone, for example. It is characterized by less density (i.e. 5% less dense than Arkansas hard white stone), and it is both softer and of less tensile strength. Hence it is easier to machine and form. Washita stone also produces a more aggressive honing action than other forms of Novaculite. Because there are more connecting voids overall in the Washita stone, as quarried, and because of the larger particle size and reduced characteristic hardness, Washita stone is often more suited for general sharpening purposes.

It will also be appreciated that natural Washita stone is often characterized by distinctive and aesthetically pleasing color striations or patterns often beautifully interspersed with multicolored swirls and layers. Such color patterns are especially enhanced by flat face cutting and lapping which shapes the stone for its use as a sharpening hone. It is suggested that the characteristic color patterns of Washita stone result from contamination from metal oxides diffused through the product in the heat of formation. However, as explained in our copending parent patent application, the surface color zones in mined novaculite stone often coincide with regions of cleavage or weakness.

It is desirable to provide a system for artificially manufacturing "striated" Washita novaculite exhibiting aesthetically attractive characteristics, while as the same time minimizing the above discussed weaknesses. Thus, for example, a process for creating an artificial Washita stone without contaminant sand pits, fault lines, incursions, and quartz seams is warranted. Moreover, it is advantageous to produce an artificial Washita novaculite stone which exhibits substantially homogenous density so as to consistently either "polish" or "grind" as desired by the user. Moreover, it is desirable to produce an appealing tinted, Washita stone without cleavage or fissures which shorten the life expectancy of prior art stones cut from naturally occurring novaculite deposits.

Perhaps one of the earliest patents relating to this art is U.S. Pat. No. 1,983,082 issued to W. L. Howe on Dec. 4, 1934. The latter reference describes how raw materials of granular abrasive material may be formulated with a vitrified bond after a mixing process. The bond is matured after pressing and shaping by heating until vitrification occurs, at which point cementing of the various constituent grain occurs. Such a bond results in regions of voids, between which the "grinding" abrasive characteristics of the resultant stone are produced. Other prior art is seen in the following U.S. Pat. Nos. 2,880,081, 3,003,860, 3,092,476; 3,142,138; and, 4,541,843.

However, no process known to us has hitherto yielded artificially produced Washita type novaculite exhibiting superior color qualities, homogeniety, uniform density, high strength (both tensile and abrasive), high MOH hardness in excess of MOH 7.0, and virtually complete omission of fissures, contaminating incursions and the like.

Summary of the Invention

The present invention comprises a process for artificially producing tinted Washita novaculite stone of consistently high quality characteristics. The composite Washita stone produced through the process of the present invention exhibits a substantial number of the attributes of the artificial novaculite of the above cross-referenced copending application, but is additionally characterized by aesthetically pleasing coloration and highly desirable utilitarian sharpening attributes.

The instant product and process contemplates the formation of two primary abrasive mixes which are suitably layered together prior to the cold pressing step. The untinted mix may be blended substantially in accordance with the teachings of our above referenced copending patent application, or it may be blended as hereinafter described. The second abrasive mix is tinted to provide coloration. Layers of the tinted and untinted mixes are thereafter interspersed prior to cold pressing in order to yield a "swirled" or "layered" Washita stone after proper subsequent vitrification.

Formulation of the untinted mix preferably starts with a source of abrasive powder, such as 100 mesh Novacite-brand novaculite powder. Alternatively, the untinted mix may consist of a mixture of approximately 70%–80% by weight of 100 mesh novaculite powder, and approximately 20% to 30% by weight of 200 mesh novaculite powder. The abrasive powder is combined with a wetting agent and water, a temporary binder, a quantity of flux such as calcium stearate and a high refractory frit.

This resultant mixture is thoroughly blended to form a neutral intermediate mixture characterized by the following approximate constituent percentages (by weight): 60–70% of dry abrasive; 4–7% of the temporary binder; 1–10% of the wetting agent; approximately 1–5% flux, and approximately 18–30% frit. After screening a ball clay is mixed in to provide a final untinted mixture.

The tinted mixture is made from a supply of the above described untinted mixture, which is combined with a color glaze for suitable coloring. In the tinted mixture, color glaze will comprise approximately 10% by weight. A variety of well know color glazes are readily commercially available in a variety of tints. The tinted mix will constitute a random percentage of the total stone, preferably not to exceed 15%.

The stone produced at 3 tons per square inch in this manner closely matches the performance of the "Washita" honing stone when fired at cone "04." The pressing procedure of the present invention imposes a load not to exceed five tons per square inch on a mixture of novaculite, bond and binder from any direction assuming the mixture is 1.5–1.8% fluid.

Vitrification is achieved by firing the pressed parts in an electric furnace up gentle ramps to slowly approach cone 04, and there a soak time of approximately 2 hours is preferred. The bond has been specifically formulated to vitrify at cone 04, "down hard".

Therefore a basic object of the present invention is to artificially produce a high quality, vitrified novaculite product.

A basic object of the present invention is to produce a high quality, artificial vitrified novaculite Washita stone product which closely resembles the "real thing."

Another object of the basic invention is to provide a vitrified novaculite Washita stone which exhibits greater wear resistance to mechanical friction loading than natural Washita stone.

A still further object is to provide a process for manufacturing vitrified novaculite Washita stone suitable for use in sharpening hones and stones, which product exhibits aesthetically pleasing coloration and surface appearance.

A still further object is to provide a process for manufacturing vitrified novaculite Washita stone suitable for use in sharpening hones and stones, which product attractively exhibits more than one aesthetically pleasing color swirl or striation upon one or more finished exterior surfaces thereof.

A similar object is to produce an artificially vitrified novaculite Washita stone product suitable for use in sharpening stones which exhibits substantially homogenous density but concurrently attractively displays non-uniform coloration.

A related object is to provide a process for artificially producing Washita stone products which lack contaminating incursions such as sand pits, fault lines, freeze lines, quartz seams, weakening fissures, cleavage lines or the like.

A fundamental object is to provide an economically sound process for artificially producing aesthetically tinted Washita stone, and a related object is to do so without producing adjacent regions (i.e. tinted and untinted) of nonhomogenous physical characteristics.

A still further object of the present invention is to provide a Washita stone product of the character described of a highly aesthetic and marketable appearance.

Yet another object is to provide an artificial Washita stone product of the character described which exhibits tensile strength at least equal to naturally occurring Washita stone.

Another fundamental object is to provide a process adapted to employ raw materials produced from naturally occurring abrasive novaculite (i.e. silica) which may be vitrified through a bonding process to artificially form a new, Washita stone product which is superior in sharpening features, durability and overall characteristics when compared to naturally-quarried Washita stone.

Another fundamental object is to provide a process for forming an artificial Washita stone product of the character described which assures the user of reasonable quality controls such that various batches of products produced with given parameters may be uniformly expected to produce virtually identical end products.

Of course a fundamental object is to provide an artificially produced Washita sharpening stone which exhibits superior sharpening abilities when compared to quarried Washita stone.

A fundamental object of the present invention is to provide a process for artificially producing a tinted Washita abrasive which is superior to naturally occurring Washita stone whether used in dry sharpening, or with water lubrication or with oil lubrication.

A still further object is to provide a system for arificially producing Washita stone which utilizes the same chemistry as disclosed in our above referenced copending patent application, but which utilizes two mixes at the cold pressing station, one suitably dyed and one neutral.

These and other objects and advantages of the present invention, along with features of novelty appurtenant thereto, will appear or become apparent in the course of the following descriptive sections.

Brief Description of the Drawings

In the following drawings, which form a part of the specification and which are to be construed in conjunction therewith, and in which like reference numerals have been employed throughout wherever possible to indicate like parts in the various views.

Detailed Description

Figure 1:
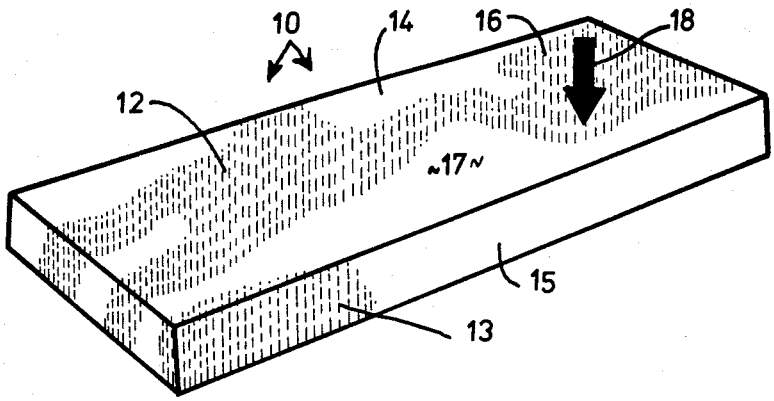
FIG. 1 is an isometric view of a Washita sharpening stone artificially constructed in accordance with the teachings of the present invention, which view has been lined for purposes of illustrating color; and, FIG. 2 is an isometric view of an alternative Washita stone produced in accordance with the teachings of the present invention, illustrated disposed in an orientation for proper cold pressing, and which view has been lined for purposes of illustrating color.
Figure 2:
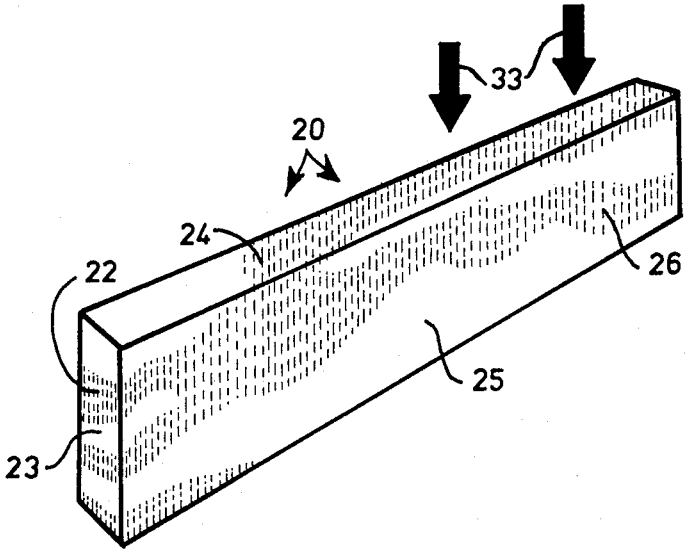

With initial reference now directed to FIGS. 1 and 2 of the appended drawing, generally rectangular sharpening stones artificially produced through the teachings of the present invention have been generally indicated by the reference numerals 10 and 20. Both have been produced from commercially available abrasive novaculite powder through the processes herein described.

Artificially colored or tinted regions associated with stone 10 have been designated by the reference numerals 12, 13 and 16. These regions are separated by natural or untinted regions 14 and 15. Similar colored regions on stone 20 have been generally indicated by the reference numerals 22, 24, and 26, and typical bordering untinted layers such as regions 23 and 25 are also illustrated. The untinted regions (i.e 15 or 23) result from a first primary untinted or neutral mix; the colored regions layers result from a second primary mix which is appropriately tinted.

A comparison of FIGS. 1 and 2 of the present invention with the drawings of our above cited pending patent application will reveal the lack of weakening fissures in the stone surface. Unlike natural Washita stone, the density and hardness of adjacent colored and untinted regions will be substantially homogenous. Outer surfaces such as planar surface 17 (FIG. 1) will virtually totally lack deleterious imperfections such as sand pits, cleavage lines and the like. It will thus be apparent that as a knife is moved across the upper outer surface 17 of hone 10 it will be exposed to substantially uniform abrasive regions, notwithstanding the fact that regions of different color will be encountered. The key to providing an artificial Washita stone colored in accordance with the present invention, is to appropriately layer the tinted and untinted mixes of the present invention prior to the cold pressing step.

The instant process combines an untinted (i.e. "color neutral") blend of abrasive with layers of a tinted abrasive mixture. Both mixtures contemplate the selection of an initial raw silica powder for use and subsequent vitrification. A candidate powder could be any of the silicon dioxides of relatively low porosity which falls on the MOH scale between 7.0 and 7.5. In the best mode of the invention novaculite powder which is formed by grinding naturally occurring novaculite is employed to produce either constituent mixture. Preferably Novacite-brand Novaculite powder is employed. This powder appears as a white granular powder, and it is substantially uniformly graded, and free of foreign matter contaminants. It is impervious to many acids and alkalies, in its loose granular form, and its true specific gravity at 70 degrees F., is approximately 2.66.

The dry tinted and untinted abrasive mixtures of the present invention both preferably comprise mixtures of 100 mesh Novacite powder. Alternatively a blend of between 70% and 80% by weight of 100 mesh novaculite powder as aforedescribed, and approximately 20% to 30% by weight of 200 mesh novaculite powder may be employed.

TABLE 1

COMPOSITION OF TYPICAL NOVACULITE POWDER (PERCENTS)

| | |
|---|---|
| Silica | 99.490 |
| Ferric Oxide | 0.039 |
| Aluminum Oxide | 0.102 |
| Titanium Oxide | 0.015 |
| Calcium Oxide | 0.333 |
| Magnesium Oxide | 0.021 |

Table 2 exhibits the screen analysis characteristics of a preferred constituent novaculite powder:

TABLE 2: SCREEN ANALYSIS

100% through U.S. Standard Sieve Series #40
25% Maximum Retained on Control Sieve #100
50% Minimum Retained on Sieves #120, #140, and #200

A. Constant Mesh Abrasive Mixtures

An initial mixture of constant mesh dry abrasive is selected. 100 mesh Novacite powder is ideal. It is mixed with a wetting agent, such as a 16:1 mixture of water and liquid organic concentrate (Amway LOC); a temporary binder (such as acid treated dextrin); a supply of flux such as calcium stearate; and a high refractory frit. A high borax firt with 62% silica and a fusion point of 1650 degrees F. is acceptable, and Dow Peox-brand frit is ideal. In both cases type 3GF frit produced by 0. Hommel is preferred.

The resultant still untinted mixture is thoroughly blended to form an intermediate, untinted mixture, which in the best mode, is characterized by weight of approximately 60–70% of said initial dry abrasive, 4–7% of the temporary binder, 1–10% of the wetting agent, approximately 1–5% flux, and approximately 18–30% frit. In an experiment a successful intermediate mixture comprised an approximate constituency, by weight, of 62–66% of said dry abrasive, 5–7% of said temporary binder, 2–4% of the wetting agent, 1–2% flux, and 24–25% frit. The latter mixture is then subjected to gyratory screening to break up particulates and aerate the mixture providing a second intermediate untinted mixture which is then mixed with a ball clay to provide a final untinted mixture. Tennessee #1 Ball Clay from Kentucky and Tennessee Clay Company is appropriate.

Preferably the final untinted mixture consists of approximately 85–95% of the untinted intermediate mixture and approximately 5–15% of Tennessee ball clay. In one experiment the final untinted mixture consisted of approximately 92% of the second intermediate mixture and 8% of Tennessee ball clay. After final screening, the final untinted mixture is suitable for cold pressing and subsequent vitrification as hereinafter described.

Formulation of the second or tinted mixture starts with a predetermined quantity of the untinted mixture described above. The 100 mesh novaculite abrasive mix (i.e. the first abrasive mix with 100 mesh Novacite and containing the mixed-in ball clay) is preferred. A color glaze stain, such as a commercially available Pemco-brand color glaze stain, is added directly with the mixer stopped, and blended until uniform coloration is apparent.

TABLE 3

| Preferred Washita Mix Analysis | | |
|---|---|---|
| Tinted Mix | | Untinted Mix |
| 50–55 | 100 Mesh Novacite | 50–60 |
| 18–19 | O. Hommel Frit | 18–20 |
| 10–12 | Tenn #1 Clay | 10–12 |
| 1–2 | Flux | 1–2 |
| 5–15 | Color Glaze | 0 |
| 4–5 | Temporary Binder | 4–5 |
| 2–4 | Wetting Agent | 2–4 |

B. The Mixed-Mesh Abrasive Mixture

Alternatively the untinted dry abrasive may comprise a mixture of between 70% and 80% by weight of 100 mesh novaculite powder as aforedescribed, and approximately 20% to 30% by weight of 200 mesh novaculite powder.

The mixture of such dry abrasive is thereafter mixed with the wetting agent, a temporary binder (such as acid treated dextrin); the flux (i.e. preferably calcium stearate) and, the high refractory frit. A high borax frit with 62% silica and a fusion point of 1650 degrees F. is ideal, and type 3GF frit produced by 0. Hommel is preferred. The latter resultant mixture is thoroughly blended to form a first intermediate mixture having a weight of approximately 62–66% of said dry abrasive, 5–6% of the temporary binder, 2–4% of the wetting agent, approximately 1–2% calcium stearate, and approximately 22–25% frit. In this mode of the invention the first intermediate mixture may be characterized by a weight of approximately 64% of said dry abrasive, 5–6% of the temporary binder, 3% of the wetting agent, approximately 2.0% flux and approximately 24% frit.

This first intermediate untinted mixture is then subjected to gyratory screening whereby to break up particulates and aerate same to provide a second intermediate mixture which is then mixed with a ball clay to provide a final mixture. Tennessee #1 Ball Clay from Kentucky and Tennessee Clay Company is appropriate. Preferably the final mixture consists of approximately 91–93% of the second intermediate mixture and approximately 7–9% of Tennessee ball clay. In this mode the final untinted mixture consists of approximately 91–92% of the second intermediate mixture and 8–9% of Tennessee ball clay.

After final screening, this untinted abrasive mixture is suitable for tinting with color glaze, not to exceed fifteen percent (15%) by weight. After alternately layering the tinted and untinted mixtures together, edgewise cold pressing and subsequent vitrification may proceed as described hereinafter.

TABLE 4

| 100/200 Untinted Mixture | |
|---|---|
| DRY AND WET INGREDIENTS | APPROX. PERCENTAGE |
| 1. Dry novaculite abrasive powder | |
| 75% 100 mesh | 44 |
| 25% 200 mesh | 15 |
| 2. DRY powdered glass (Frit) Ground to 325 mesh (fusion point of 1650 degrees F. is desirable) | 22 |
| 3. Dry Tennessee Ball Clay (No. 1) | 9 |
| 4. Flux (Dry Calcium Stearate powder very finely ground) | 2 |
| 5. Temporaray Binder (acid treated Dextrin powder, 500 mesh) | 5 |
| 6. Water mixed with liquid organic concentrate 16:1 | 3 |

The pressing procedure of the prior simulated Novaculite stone contemplates pressure application at right angles to the broadest surface exposure available in any given stone. Thus pressing pressure was applied in the direction of arrow 18 in FIG. 1. However, in the process proposed herein, to produce a simulated "Washita" sharpening stone the die cavity is oriented on edge, and the cavity is alternately filled with the tinted and untinted mixes of the present invention in a manner so as to produce a layered or striated pattern on the face of the sharpening stone as evidenced by FIGS. 1 and 2.

Using a mold configuration which orients the stone product as in FIG. 2, the cavity opens on the earth plane over the thickness and the length of the stone so that the layers loaded into the mold actually arrange themselves across the honing face. Two hoppers attached to the press at a position well above the plane of pressing communicate through flex tube chutes into an automated shaker box located over a conventional funnel chute. When the shaker box is shuttled back and forth over a common funnel chute, alternate layers of tinted and untinted mix are deposited in a reservoir at the left of the mold cavity.

When the reservoir is shuttled across the mold cavity, the layered mixture gravity feeds into the mold. When the box is returned to home position it strikes off the mold cavity preparing it for the pressing step. The press ram enters the mold from the top and compresses the striated mixture at right angles to the top edge (i.e. in the direction of arrows 33 of FIG. 2) resulting in colored "streaks and swirls" on the face of the stone. The stone is then ejected up from the bottom and placed on tile for the drying and firing steps.

Vitrification is achieved by firing the "green" ceramic body in an electric furnace up gentle ramps to slowly approach cone 04, and there a soak time of approximately two hours is preferred. The bond has been specifically formulated to vitrify at cone 04, "down hard." Softening occurs at about two thousand degrees F. depending upon the trace oxides and crystalline structure of the silica. It is preferred to fire just under this point to avoid crystalline damage. The bonding agent is specially formulated to effectuate vitrification at Cone 04, and the gentle ramps prevent the subsequent generation of the above complained of fissures and contaminating incursions characteristic of naturally occurring novaculite.

The tinted Washita stone produced through the aforesaid process has exhibited comparable tensile strength, superior durability, and improved controlability relative to naturally occurring Washita stone. While the finished product may not be harder than the naturally occurring stone, actual samples have been found to be highly resistant to scarring, or flaking, and they have exhibited a superior resistance to general wear and abrasion.

From the foregoing, it will be seen that this invention is one well adapted to obtain all the ends and objects herein set forth, together with other advantages which are obvious and which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A process for artificially producing a vitrified composite Washita stone product, the process comprising the steps of:

A. Producing an untinted mixture of abrasive by:

providinding a supply of dry abrasive novaculite powder;

mixing said dry abrasive powder with a wetting agent, a temporary binder, a flux, and a high refractory frit, whereby to form an intermediate mixture having an approximate constituency, by weight, of 60%–70% of said dry abrasive, 4–7% of said temporary binder, 1–10% of the wetting agent, 1–5% flux, and 18–30% frit; and, mixing said intermediate mixture with ball clay to provide an untinted mixture, which after final screening, is suitable for cold pressing and subsequent vitrification, said untinted mixture characterized by the following approximate constituency by weight: 85–95% of said intermediate mixture, and 5–15% of said ball clay;

B. Blending a predetermined quantity of said untinted mixture with a coloring agent to provide a tinted abrasive mix;

C. layering alternate portions of said tinted and untinted mix together;

D. Cold pressing the mixture of step C above into a desired shaped product; and, E. firing said product of step D above to vitrify same.

2. The process as defined in claim 1 wherein said source of dry abrasive powder in step A comprises 100 mesh novaculite powder.

3. The process as defined in claim 1 wherein said source of dry abrasive powder in step A comprises a mixture of 70–80% by weight 100 mesh novaculite powder and approximately 20–30% by weight 200 mesh novaculite powder.

4. The process as defined in claim 1 wherein said first intermediate mixture of step A comprises an approximate constituency, by weight, of 62–66% of said dry abrasive, 5–7% of said temporary binder, 2–4% of the wetting agent, 1–2% flux, and 24–25% frit.

5. The stone product produced through the process of claim 2.

6. The process as defined in claim 1 wherein said firing step employs gentle ramps whereby cone 04 is slowly approached, and a soak time of approximately two hours at 1950 degrees F. is employed.

7. The process as defined in claim 6 wherein said high refractory frit is approximately 300–400 mesh.

8. The process as defined in claim 6 wherein the wetting agent comprises an approximately 16:1 mixture of water and liquid organic concentrate.

9. The process as defined in claim 6 wherein said frit comprises a high borax firt with 62% silica and a fusion point of 1650 degrees F.

10. The process as defined in claim 6 wherein said cold pressing step includes the step of raising forming pressures to approximately five tons per square inch.

11. The process as defined in claim 1 wherein said untinted mixture of step A is characterized by weight of approximately 92% of said first intermediate mixture and 8% of said ball clay.

12. A process for artificially producing a relatively high density vitrified composite Washita stone product, the process comprising the steps of:

providing a supply of dry abrasive of at least 95% by weight silicon dioxide;

mixing said dry abrasive with a wetting agent, a temporary binder, a flux, and a high refractory frit, whereby to form an intermediate mixture having an approximate constituency, by weight, of 60–70% of said dry abrasive, 4–7% of said temporary binder, 1–10% of the wetting agent, 1–5% flux, and 18–30% frit;

mixing said intermediate mixture with ball clay to provide a final untinted mixture, which is suitable for cold pressing and subsequent vitrification, said final untinted mixture characterized by the following approximate constituency by weight: 85–95% of said intermediate mixture, and 5–15% of said ball clay;

providing a supply tinted abrasive mixture my blending a quantity of said final untinted mixture with a quantity of color glaze;

layering alternate portions of said tinted and untinted abrasive mixtures together;

pressing the mixture of said last mentioned step; and, firing the product from said pressing step to vitrify same.

13. The Washita stone product formed from the process of claim 12.

14. The process as defined in claim 12 wherein said first intermediate mixture of step A comprises an approximate constituency, by weight, of 62–66% of said dry abrasive, 5–7% of said temporary binder, 2–4% of the wetting agent, 1–2% flux, and 24–25% frit.

15. The process as defined in claim 14 wherein said source of abrasive comprises a mixture of weight 100 mesh novaculite powder and weight 200 mesh novaculite powder;

16. The Washita stone product formed from the process of claim 14.

17. An artificial, vitrified Washita stone product formed by the process of :

A. Producing an untinted mixture of abrasive by:

providing a supply of dry abrasive novaculite powder;

mixing said dry abrasive powder with a wetting agent, a temporary binder, a flux, and a frit, whereby to form an intermediate mixture having an approximate constituency, by weight, of 60%–70% of said dry abrasive, 4–7% of said temporary binder, 1–10% of the wetting agent, 1–5% flux, and 18–30% frit;

and, mixing said intermediate mixture with ball clay to provide an untinted mixture, which after final screening, is suitable for cold pressing and subsequent vitrification, said untinted mixture characterized by the following approximate constituency by weight: 85–95% of said intermediate mixture, and 5–15% of said ball clay;

B. blending a predetermined quantity of said untinted mixture with a color glaze to provide a tinted abrasive mix;

C. layering alternate portions of said tinted and untinted mix;

D. pressing the layered mix of step C above into a desired shaped product; and,

E. firing siad product of step D above to vitrify same.

18. The process as defined in claim 17 wherein said source of dry abrasive powder in step A comprises 100 mesh novaculite powder.

19. The process as defined in claim 17 wherein said source of dry abrasive powder in step A comprises a mixture of 70–80% by weight 100 mesh novaculite powder and approximately 20–30% by weight 200 mesh novaculite powder.

20. The process as defined in claim 17 wherein said first intermediate mixture of step A comprises an approximate constituency, by weight, of 62–66% of said dry abrasive, 5–7% of said temporary binder, 2–4% of the wetting agent, 1–2% flux, and 24–25% frit.

* * * * *